US005159235A

United States Patent [19]

Ochoa et al.

[11] Patent Number: 5,159,235

[45] Date of Patent: Oct. 27, 1992

[54] HOLLOW LAMP BRIDGE

[75] Inventors: Carlos G. Ochoa, El Paso, Tex.; German C. Aguilar, Juarez, Mexico

[73] Assignee: GTE Products Corporation, Danvers, Mass.

[21] Appl. No.: 572,652

[22] Filed: Aug. 10, 1990

[51] Int. Cl.[5] ..... H01J 1/90

[52] U.S. Cl. ..... 313/276; 313/274; 313/275; 313/256; 445/29; 445/32; 445/33

[58] Field of Search ..... 313/276, 275, 274, 315, 313/569, 578, 579, 256; 445/29, 32, 33, 34; 428/34.4, 432

[56] References Cited

U.S. PATENT DOCUMENTS

| | | | |
|---|---|---|---|
| 3,543,962 | 12/1970 | Peterson et al. | 313/276 |
| 3,626,236 | 12/1971 | Robinson et al. | 313/276 |
| 3,785,019 | 1/1974 | Chiola et al. | 445/32 |
| 4,023,060 | 5/1977 | Pike et al. | 313/276 |

*Primary Examiner*—Donald J. Yusko
*Assistant Examiner*—N. D. Patel
*Attorney, Agent, or Firm*—William E. Meyer

[57] ABSTRACT

A lamp bridge may be formed from a siliceous hollow tube positioned between and melted to bridge supports. The hollow tube melts more quickly, and more completely, and therefore bonds stress free and more durable to the bridge supports.

9 Claims, 3 Drawing Sheets

HOLLOW LAMP BRIDGE

TECHNICAL FIELD

The invention relates to electric lamps and particularly to incandescent electric lamps. More particularly the invention is concerned with a tungsten halogen lamp with a tubular bridge support for the filament.

BACKGROUND ART

To increase light output from a lamp, a filament may be made larger, or longer. Larger diameter filaments are awkward to position, so in general filaments are made longer. The longer filament is then held in several places along its length for stable positioning. A common method holding the lengthened filament is to fold the filament back and forth and hold the end of each fold with a support wire. The opposite ends of the support wires are then coupled to an insulator, usually made of quartz or glass, called a bridge. The bridge extends or bridges between two bridge supports, usually metal rods. The metal rods may or may not provide the electrical connections for the two ends of the filament.

Currently bridges are made from solid, cylindrical quartz rods. The solid quartz rod is flame heated to a softened condition and then pressed onto the support rods and support wires. FIG. 1 shows a prior art solid rod bridge in cross section being heated by a flame. FIG. 2 shows a prior art solid rod bridge in cross section after being heated. Shading indicates the heat distribution. The bridge then molds around the support rods and wires, and after cooling should remain permanently positioned against them. The molding process results in a number of problems. Heating the entire mass of the bridge to pliability in the location where the molding takes place cannot be done quickly, and uniformly. As shown in FIG. 2, the heated side of the solid rod tends to be hotter and more pliable, while the opposite side tends to be colder and less pliable during the pressing. Only a fraction of a solid quartz rod is in a fully plastic state when the coil support wires and side rods are pressed. A fair portion, indicated by the shaded area in FIG. 2, of the rod is cooler and less pliable. Only, a limited portion of the bridge can then be spread up, down and around the support rod when the two are pressed together. A weak joint is then sometimes formed.

For an insufficiently melted bridge, the unmelted portion may also crack when pressed against the support rod. Even for a properly heated bridge, a thermal gradient exists across the bridge diameter, and residual stresses may be left in the bridge. The residual stresses may result in cracks on subsequent mechanical or thermal stress. When the bridge cracks, the lamp frequently fails. Another problem is that a sufficient length of the bridge needs to wrap around the support rod when melted to a pliable state. If the bridge is too short, or insufficiently melted, the melted bridge fails to wrap around the support rod and permanently couple with the support rod. High rework rates and scrap factors are the result of cracked or broken bridges. Lamp costs then rise. There is then a need for a better bond between the bridge and bridge support in incandescent lamps.

DISCLOSURE OF THE INVENTION

A hollow bridge for an incandescent lamp may be formed with a first bridge support formed from a metal rod, a second bridge support, also formed from a metal rod, and a siliceous material tube positioned between the first bridge support and the second bridge support and melt fused to the first bridge support and second bridge support.

BEST MODE FOR CARRYING OUT THE INVENTION

Figure 1:
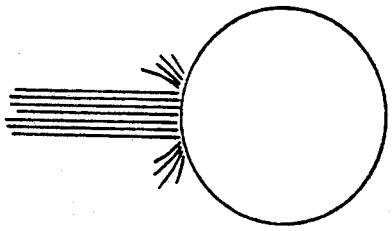
FIG. 1 (PRIOR ART)
FIG. 1 shows a prior art solid rod bridge in cross section being heated by a flame.
Figure 2:
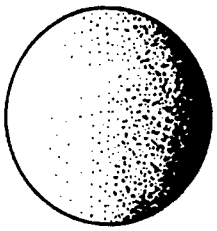
FIG. 2 (PRIOR ART)
FIG. 2 shows a prior art solid rod bridge in cross section after being heated. Shading indicates the heat distribution.
Figure 3:
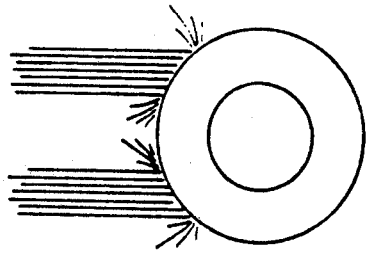
FIG. 3 shows a preferred embodiment of a hollow in cross section being heated by flames.
Figure 4:
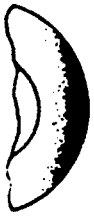
FIG. 4 shows a preferred embodiment of a hollow bridge in cross section after being heated. Shading indicates the heat distribution.

An improved bridge construction uses a cylindrical hollow quartz tube instead of a solid cylindrical quartz rod to form a lamp bridge. The hollow tube construction has a smaller thermal mass and as a result may be heated faster, and more completely. Residual stress is virtually eliminated by the reduced thermal mass of the tube. A better bond is then formed between the bridge and bridge supports. FIG. 3 shows a preferred embodiment of a hollow bridge in cross section being heated by flames. FIG. 4 shows a preferred embodiment of a hollow bridge in cross section after being heated. Shading indicates the heat distribution.

Figure 5:
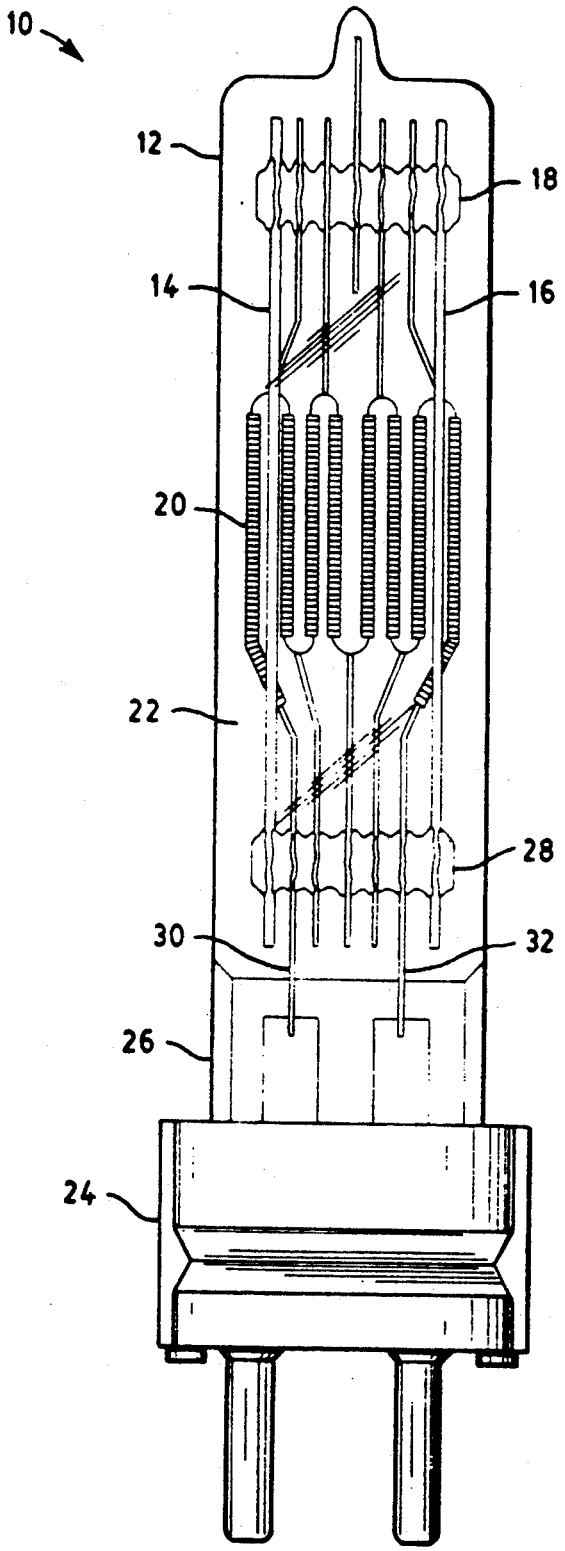
FIG. 5 shows a cross section of a tungsten halogen lamp with a preferred embodiment of a hollow bridge.

FIG. 5 shows a preferred embodiment of a tungsten halogen lamp 10 with a hollow bridge. The lamp 10 comprises an envelope 12, a first bridge support 14 formed from a metal rod, a second bridge support 16, a bridge 18 in the form of a tube, and a filament 20. In some embodiments, the filament 20 may be electrically coupled between the first bridge support 14, and the second bridge support 16 to provide incandescent illumination on the application of electric power. In the preferred embodiment, the filament ends are electrically coupled to separate power leads.

The envelope 12 may have any convenient form or material. Typically envelopes are made of quartz or glass, and have either a bulbous or tubular forms. The envelope 12 includes an interior surface defining an enclosed volume 22. The enclosed volume 22 is sealed, and the envelope 12 has a base 24. The preferred base is separately formed and coupled to the envelope. Alternatively, a portion of the envelope may be heated and formed as a base.

The first bridge support 14 may be formed from a metal rod coupled to the envelope 12. A nonconductive material may be used as the first bridge support 14, but the strength and toughness of metal is preferred for the first and second bridge supports 14, 16. A method sometimes used in coupling the envelope 12 to the bridge support is to capture the bridge support in the envelope seal 26 during sealing. The bridge support may penetrate the seal 26 area to be exposed on the exterior for direct electrical connection, or may be coupled through a sealing foil to an exterior lead for electrical connection. The variety of useful lamp seals is generally known in the art. The first bridge support 14 may be captured on the interior side of the seal 26 area and otherwise wholly contained in the envelope 12. The first bridge support 14 is then at least partially enclosed in the envelope 12, and not infrequently electrically coupled through the seal 26 area to receive electric power. The preferred lamp couples the bridge supports 14, 16 between two bridges 18, 28, and uses sturdy power leads 30, 32 to support one of the bridges 28.

The second bridge support 16 may be similarly formed and supported in the envelope 12. In particular, the second bridge support 16 may be formed from a metal rod, at least partially enclosed in the envelope 12, and electrically couple to receive electric power. The second bridge support 16 may function as the second electrical input to the lamp 10. In the preferred embodiment, the second bridge support 16, is captured between the first bridge 18, and the second bridge 28.

Figure 6:
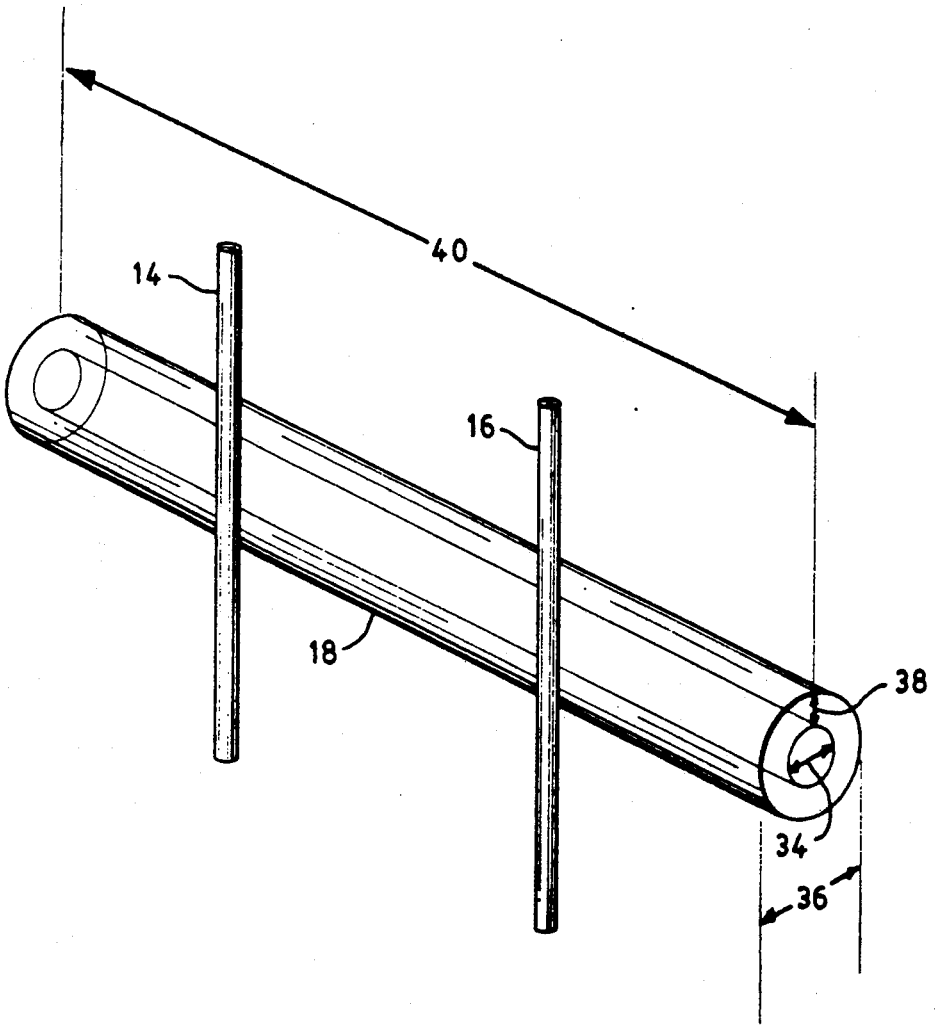
FIG. 6 shows a perspective view of a hollow bridge prior to pressing to bridge supports.

Positioned between the first bridge support 14 and the second bridge support 16 and melt fused to the first bridge support 14 and at least coupled to the second bridge support 16 is the bridge 18. The first bridge support 14, and second bridge support 16 lie adjacent, and approximately perpendicularly across the bridge 18 as shown in FIG. 6. In the preferred embodiment, the bridge 18 is formed as a hollow tube made of a melt formable insulating material. FIG. 6 shows a perspective view of a hollow bridge prior to pressing to bridge supports. In particular, the preferred bridge 18 is made of a hollow siliceous material such as quartz or glass. The tubular bridge 18 has an inside diameter 34, an outside diameter 36, a wall thickness 38 and a length 40. The inside diameter 34 is sufficiently large to reduce the thermal mass of the bridge 18. The inside diameter 34 is not so great that the tube has insufficient strength to hold the support wires. An inside diameter 34 of from one-third to about five-eighths of the outside diameter 36 is suggested. Applicant has found an inside diameter 34 of one-half of the outside diameter 36 works well. The wall thickness in one example was about 1.0 millimeter, and the inside diameter was about 2.0 millimeters. The length 40 is sufficient to span the distance between the first bridge support 14, and second bridge support 16 with an additional amount of material to be adequately molded around the bridge supports 14, 16. The use of circular cross sectional tubes for the tubular bridge 18 is a matter of convenience. Square, or other shaped tubes may be used for the tubular bridge 18.

With a quartz tube construction for the bridge 18, the fire from a burner very quickly melts the quartz tube and collapses the flame side of the tube against the opposite side of the tube thereby transferring the heat of the melted side to the opposite side of the tube. A much larger cross sectional area of the tube is then heated to a plastic state. When the heated tubular bridge 18 is pressed to the bridge supports, a greater spreading of the tubular bridge 18 occurs, yielding an improved bond with the bridge supports. In a typical prior art assembly, an average length of about 3.68 millimeter (0.145 inch) of the bridge support was covered by the heated solid rods. When a tubular bridge was used, about 4.82 millimeter (0.190 inch) of the tubular bridge on average covered the support rods and coil supports. This was a 31 percent increase in the covered length, thereby providing a much more solid bond between the bridge 18 and bridge support.

The fires needed for heating the quartz tubes can be obtained from natural gas, while in the prior construction a hydrogen fire was required. More BTU's were needed to bring the solid quartz rods to a plastic state. Natural gas flames are easier to regulate, safer to operate, and cost less to operate. The preferred burners have two parallel rows of gas holes separated by about the diameter of the bridge and angled towards the bridge axis.

In a working example some of the dimensions were approximately as follows: The hollow tube used for the bridge had an inside diameter of 2.25 millimeter (0.0885 inch), and outside diameter of 4.25 millimeter (0.1675 inch), and an overall length of 22.0 millimeter (0.866 inch). The first and second supports rods were each made of molybdenum, with a diameter of 0.72 millimeter (0.0285 inch). The rods were separated by 18.5 millimeter (0.7285 inch). The burners had two parallel rows of holes separated by 2.03 millimeter (0.08 inch), and angled toward the bridge axis by about five degrees.

Using tubular bridges substantially reduces the amount of broken bridges caused by a residual stress in the glass. In one example, the breakage rate was reduced from about 5.0 percent to about 0.2 percent. The tubular bridges also increase the mechanical strength of the construction by increasing the length up and down the side rods and coil supports covered by the quartz on average from 3.68 millimeter (0.145 inch) to 4.82 millimeter (0.190 inch. The increased covered length was an increase of 31 percent on average. Both improvements occurred while the weight of the bridge was decreased by 8.5 percent.

Lamp shrinkage caused by broken bridges was reduced to almost zero when the hollow tube construction was used. The reduced breakage is thought to result from the elimination of residual stresses left in the quartz bridge. The smaller mass of the quartz tube allows a more even distribution of heat when the coil support wires, and support rods are pressed with the bridge. The even heat distribution then results in less internal stress.

The coil supports and side rods were more broadly covered by the tubular bridge. The tubular bridges are then more securely bonded to the support rods, and no longer break free.

Processing time for the bridge has been substantially reduced, since less time is needed to heat a tubular bridge to the necessary plastic state before pressing the support wires and support rods. Typically, the quartz heating time for a solid rod construction was about twelve seconds. The tubular bridge construction takes only about six seconds to heat.

The weight of the tubular bridge is lower than that of a solid rod, but the mechanical strength of the assembly has not been impaired. Typically, a bridge #4057-0083 for a C13-2000 watt-240 volt lamp NAED #546240 weights 4.120 grams when made with solid quartz and only 3.770 grams with quartz tubing construction, or an 8.5 percent reduction in weight.

A further advantage of the hollow bridge construction is that the cost of making the bridges with the quartz tubing is much lower. The prior art construction used solid quartz bridges purchased separately. Meanwhile, the exhaust tubes cut from the lamps after being exhausted and tipped were being scrapped. The length of a discarded exhaust tube was approximately seventy-five percent of the original length of the exhaust tube, leaving a tubular piece about 47.63 millimeter (1.875 inch). The Applicant found that a tubular bridge may be made from the tubulation scrap using the new method, and the tubular bridge worked better than the solid bridge. The material cost of the tubular bridge to the manufacturer is then zero. The disclosed operating conditions, dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A bridge for an incandescent lamp comprising:

a) a first bridge support formed from a metal rod, b) a second bridge support formed from a metal rod, and c) a siliceous material tube having an inner diameter and an outer diameter prior to being melt fused, extending between the first bridge support and the second bridge support, and lying adjacent and perpendicularly across the first bridge support and the second bridge support and melt fused to the first bridge support and second bridge support.

2. The bridge in claim 1, wherein the inner diameter prior to melt fusing was less that five-eighths of the outer diameter.

3. The bridge in claim 1, wherein the inner diameter prior to melt fusing was greater than one-third of the outer diameter.

4. An incandescent lamp comprising:

a) an envelope, b) a first bridge support formed from a metal rod, at least partially enclosed in the envelope, and electrically couple to receive electric power, c) a second bridge support, formed from a metal rod, at least partially enclosed in the envelope, and electrically couple to receive electric power, d) a siliceous material tube positioned between the first bridge support and the second bridge support and melt fused to the first bridge support and coupled to the second bridge support, and e) a filament electrically coupled between the first bridge support, and the second bridge support to provide incandescent illumination on the application of electric power.

5. A method of forming a coupling between a lamp bridge and bridge supports comprising the steps of:

a) providing a siliceous tube having an inner diameter and an outer diameter, b) heating the tube to a plastic state, and c) pressing bridge supports into the heated tube to mold the tube around the bridge supports.

6. The method in claim 5, wherein the inner diameter is less than five-eighths of the outer diameter.

7. The method in claim 5, wherein the inner diameter is greater than one-third of the outer diameter.

8. The method in claim 5, wherein the tube is heated sufficiently to collapse a heated side of the tube to fall against an opposite side of the tube.

9. The method in claim 6, wherein the tube is heated on a first side sufficiently to collapse the heated first side to fall against an opposite, unheated side of the tube, and the bridge supports are pressed into the collapsed first side of the tube.

* * * * *